US006820336B2

(12) United States Patent
Laitinen et al.

(10) Patent No.: US 6,820,336 B2
(45) Date of Patent: Nov. 23, 2004

(54) MAKING A POWDER METAL ROLL END FOR A HEATABLE ROLL

(75) Inventors: Arttu Laitinen, Tampere (FI); Matti Tervonen, Hyvinkää (FI); Mika Viljanmaa, Helsinki (FI); Pekka Koivukunnas, Järvenpää (FI); Erkki Leinonen, Järvenpää (FI); Hannu Vuorikari, Helsinki (FI); Erkki Kiiski, Tampere (FI)

(73) Assignee: Metso Paper, Inc., Helsinki (FI)

( * ) Notice: Subject to any disclaimer, the term of this patent is extended or adjusted under 35 U.S.C. 154(b) by 21 days.

(21) Appl. No.: 10/034,423

(22) Filed: Dec. 27, 2001

(65) Prior Publication Data

US 2002/0088120 A1 Jul. 11, 2002

(30) Foreign Application Priority Data

Dec. 29, 2000 (FI) ..... 20002885

(51) Int. Cl.[7] ..... B21K 1/02; F16C 13/00

(52) U.S. Cl. ..... 29/895.32; 29/895.22; 492/47

(58) Field of Search ..... 29/895.32, 895, 29/895.22, 895.3, 527.5, 527.6; 492/47, 46; 464/184; 165/89, 90; 419/49, 48

(56) References Cited

U.S. PATENT DOCUMENTS

| | | | | | |
|---|---|---|---|---|---|
| 1,675,274 | A | * | 6/1928 | Miller | 165/89 |
| 4,679,314 | A | * | 7/1987 | Lenz et al. | 29/598 |
| 4,692,644 | A | * | 9/1987 | Lenz et al. | 29/598 |
| 4,735,924 | A | * | 4/1988 | Arons | 501/95.1 |
| 4,916,281 | A | * | 4/1990 | Flasche et al. | 219/61 |
| 5,022,936 | A | * | 6/1991 | Tsujimura et al. | 148/525 |
| 5,051,218 | A | * | 9/1991 | Matthews | 264/40.6 |
| 5,725,466 | A | | 3/1998 | Eppli et al. | |
| 6,039,681 | A | * | 3/2000 | Heinz-Michael | 492/46 |
| 6,158,501 | A | * | 12/2000 | Koivukunnas | 165/89 |
| 6,405,790 | B1 | * | 6/2002 | van Haag | 165/90 |

FOREIGN PATENT DOCUMENTS

| | | | | |
|---|---|---|---|---|
| DE | 4036121 | | 1/1992 | |
| DE | 4404922 | | 9/1995 | |
| FI | 106054 | | 11/2000 | |
| JP | 56087609 | A * | 7/1981 | 419/49 |
| WO | WO 00/58554 | | 10/2000 | |

OTHER PUBLICATIONS

BrainyDictionary, BrainyMedia.com, Definition of: Isostatic.*

* cited by examiner

*Primary Examiner*—Marc Jimenez
(74) *Attorney, Agent, or Firm*—Stiennon & Stiennon

(57) ABSTRACT

A roll end (30) for a roll, in particular for a heatable roll, in a paper or board machine or in a finishing machine is made by a powder metallurgy process in a mold (20) such that a duct system (10) for a heat transfer medium is formed in connection with the manufacture of the roll end. A hot isostatic pressing process in particular is used in the manufacture.

7 Claims, 4 Drawing Sheets

MAKING A POWDER METAL ROLL END FOR A HEATABLE ROLL

CROSS REFERENCE TO RELATED APPLICATIONS

This application claims priority on Finnish Application No.20002885 filed Dec. 29, 2000, the disclosure of which is incorporated by reference herein.

STATEMENT AS TO RIGHTS TO INVENTIONS MADE UNDER FEDERALLY SPONSORED RESEARCH AND DEVELOPMENT

Not Applicable.

BACKGROUND OF THE INVENTION

The invention relates to a method of making a roll end for a roll in a paper or board machine or in a finishing machine, which roll end comprises a whole formed by an end flange and an axle journal, as well as a duct system situated inside the material of the roll end.

The invention relates particularly to a method of making a roll end for a heatable roll, which roll end comprises a whole formed by an end flange and an axle journal, as well as a duct system which is situated inside the material of the roll end and through which in a finished roll end a heat transfer medium intended for heating the roll is arranged to circulate from outside the roll through the axle journal and the roll end into bores of a roll shell and back.

The invention also relates to a heatable roll in a paper or board machine or in a finishing machine, which roll comprises a roll shell and roll ends which comprise an end flange and an axle journal and which are attached to the ends of the roll shell in the axial direction, the roll shell being provided with axial ducts for a flow of a heat transfer medium and at least one of the roll ends being provided with an axial central duct for passing the heat transfer medium into the roll and out of it, as well as with connecting ducts connecting the central duct and the axial ducts of the roll shell.

Heatable rolls, or so-called thermo rolls, are used, as known, in paper and board machines as well as in paper/board finishing machines, such as calenders, supercalenders and equivalent. The heating of these rolls is generally provided such that a heating medium, for example, water, steam or heating oil is passed into the roll through a roll end for heating the roll shell to a desired temperature. Most commonly, mainly axial bores have been formed in the roll shell and a heating medium has been made to circulate in them. Today, the roll ends of thermo rolls are manufactured by machining out of forging blanks made of tempering steel. The requirements for the material are high because the roll end, which comprises an end flange and an axle journal, is very heavily loaded in particular in a roll replacement situation. Moreover, the roll end is complicated in construction and expensive to accomplish because it includes a large number of blind hole bores in different directions. All ducts have been produced as blind hole bores or, in a corresponding manner, as through bores which have been plugged. In order to reduce the heat load of the roll bearing, a special vacuum insulation sleeve is used inside the axle journal, and the manufacture of this sleeve also causes additional costs. Duct systems are also needed for various purposes in roll ends of a number of rolls other than merely heatable rolls, in which connection the problems associated with the manufacture of these duct systems in particular are similar to those in connection with heatable rolls.

With respect to the state of the art, reference is further made to the publications DE 40 36 121 A1 and DE 44 04 922 C1, which also show quite clearly how many bores must be formed in the roll end in order to make it operative. In DE publication 44 04 922, these bores have additionally been produced as said blind hole bores, the making of which requires special precision. Another drawback in a system of blind hole bored ducts is constituted by sharp elbows which are produced in it and which are not optimal from the viewpoint of the flow of a medium, but which cannot be avoided by any means in boring.

SUMMARY OF THE INVENTION

An object of the present invention is to provide a new method of making a roll end for a heatable roll in a paper or board machine or in a finishing machine, which method is simpler than prior art methods and which method makes it possible to avoid making bores requiring high precision in the roll end and avoid other drawbacks associated with making these bores. Further, an object of the invention is that the strength properties of the roll end manufactured in accordance with the new method are superior to those of the roll ends manufactured in accordance with the state-of-the-art methods and thus it withstands better high loads. With a view to achieving these objects as well as those coming out later in the description, the present invention is mainly characterised in that the roll end is made by a powder metallurgy process in a mould such that at least a duct system that is placed in an end flange of the roll end is formed in connection with the stage of making the roll end by the powder metallurgy process. Advantageously, the duct to be provided in the axle journal is also formed in the same stage of manufacture. A hot isostatic pressing process in particular is used as the method of manufacture.

In the method of making the roll end, the duct system to be placed in the roll end is made first into a finished construction out of pipes by welding, the thus made pipe system is placed in a mould, the mould is filled with a metal powder and the manufacture is carried out under hot isostatic pressure.

Further, in the method, when the duct system is made, an encased cavity/encased cavities is/are formed on the pipes remaining inside the axle journal by means of a closed sleeve disposed on said pipes or by a similar means. The cavity/cavities is/are advantageously left empty or they are provided with a vacuum by suction.

In accordance with the method, the pipe system is advantageously coated on the outside with a heat insulating coating layer before the pipe system is disposed in the mould. The coating is preferably accomplished by flame spraying or by plasma spraying, and zirconium oxide or an equivalent material is used as the coating material.

In the manufacturing method, a high-alloy material, advantageously a gas-atomised medium-carbon tempering steel powder, is used as the powder metal material.

In accordance with the method, in the axle journal of the roll end, a powder material that conducts heat more poorly than steel, such as a metal matrix composite, is used at a desired depth in the region which will be under a bearing.

In the method, the pipe system forming the duct system is advantageously made out of a seamless pipe or a hollow bar, in particular out of a pipe/bar the material of which is austenitic stainless steel.

When a blank of the roll end has been made by a powder metallurgy process, the mould is dismantled, broken or machined off, and the blank is machined into a desired shape and dimensions.

The heatable roll in accordance with the invention is mainly characterised in that the roll end is made by a powder metallurgy process and that at least the connecting ducts which are provided in it and which connect an axial central duct and axial ducts of a roll shell are formed in connection with the making of the roll end.

Most advantageously, the central duct of the roll end is also formed in connection with the making of the roll end.

The duct system provided in the roll end is made in advance into a finished construction out of pipes by welding, which construction is left inside the material of the roll end in connection with the manufacture of the roll end.

The connecting ducts of the roll end in the roll in accordance with the invention advantageously comprise a radial portion and an axial portion. Between the radial portion and the axial portion there is advantageously a curved portion which connects them.

At the roll end, the axial portions of the connecting ducts which are connected to the axial ducts of the roll shell most advantageously come perpendicularly out of the end flange of the roll end.

The connecting ducts in the roll end are advantageously arranged to lead as separate ducts to the axial central duct provided in the axle journal.

The invention provides a number of significant advantages over the state-of-the-art methods and the roll ends manufactured by these methods, which advantages are described briefly below. Since the roll end is manufactured by a powder metallurgy process in accordance with the invention, the method provides a very homogeneous material which can be given good isotropic strength properties. All or at least almost all ducts needed for a heat transfer medium can be made ready in a blank by piping and encasing, thereby obviating the need to make difficult bores, and the shape and the location of the ducts can be optimised from the viewpoint of flow and heat transfer. Internal machining operations can be minimised or even omitted altogether, because the pipes can be used as such as ducts. The vacuum insulation sleeves normally arranged in axle journals can be replaced in the method in accordance with the invention with a cavity or cavities encased inside the axle journal, which cavities are either left empty or into which a vacuum is sucked afterwards. Before the final encapsulation, the outer surfaces of the inner pipe system can be coated, for example, by plasma or flame spraying with a heat insulating layer, which still further reduces the heat load of bearings. The heat load of bearings can be further lowered by making the axle material situated immediately under the bearing to a given depth from a powder material which conducts heat more poorly than normal steel, for example, from a metal matrix composite. The other properties and details of the invention come out in the following detailed description of the invention, to which the invention is, however, not narrowly confined.

BRIEF DESCRIPTION OF THE DRAWINGS

In the following, the invention will be described purely by way of example with reference to the appended figures of the drawing in which.

DESCRIPTION OF THE PREFERRED EMBODIMENTS

Figure 1:
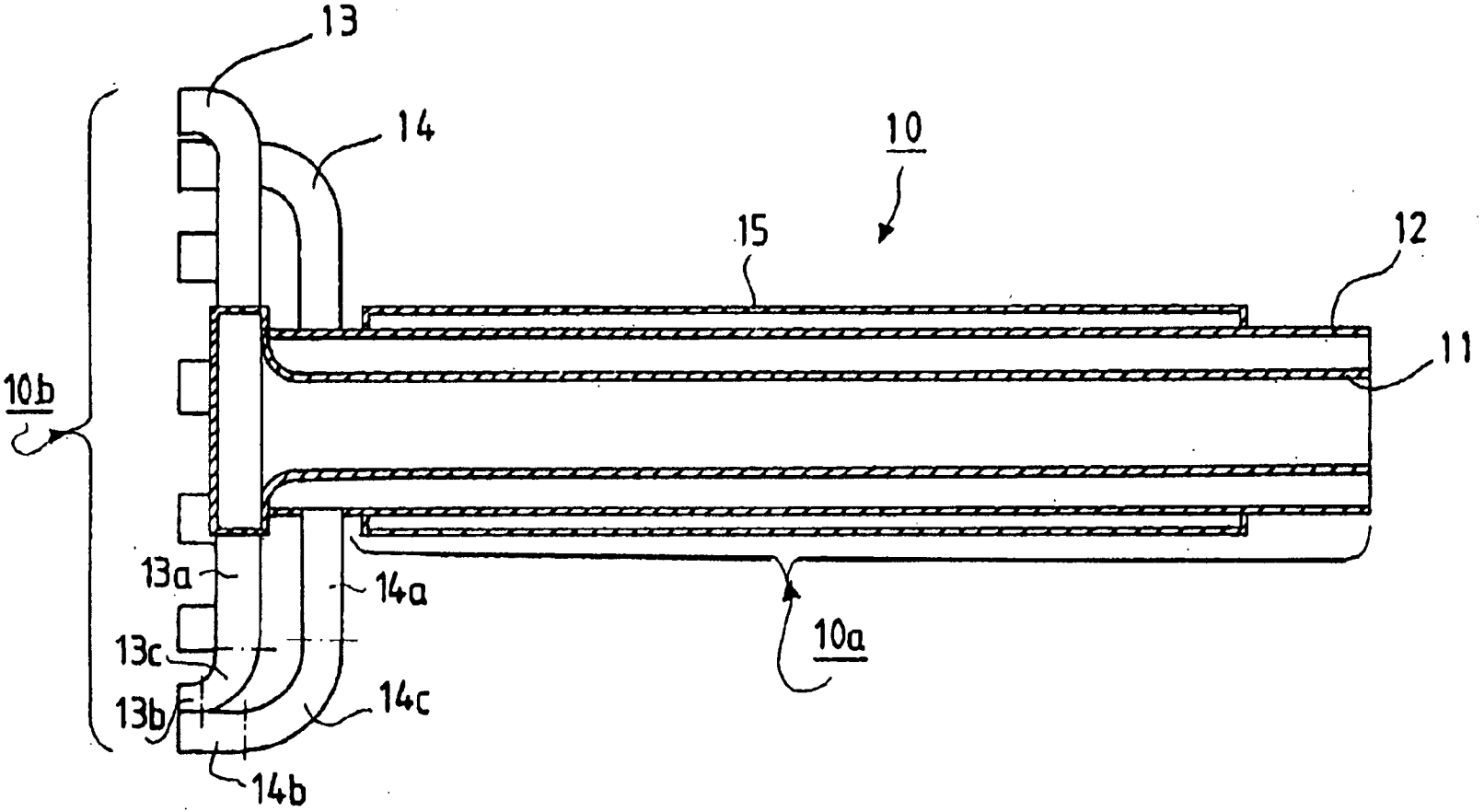
FIG. 1 is a schematic partial sectional view of a system of tubes forming a duct system in a roll end.

In the method of making a roll end comprising an end flange and an axle journal in accordance with the invention, a duct system which will be placed in the roll end is made ready first. A pipe system forming the duct system is illustrated in FIG. 1, and the pipe system 10 shown in it comprises an axial central duct 10*a* which will be placed in the axle journal of the roll end and which comprises axial inlet and outlet pipes 11, 12 for a heat transfer medium, arranged one inside the other. The pipe system 10 further includes pipes 13, 14 comprising connecting ducts 10*b*, which pipes are connected to these inlet and outlet pipes 11, 12 and will remain inside the end flange, and which pipes, when the roll end has been attached to a roll shell, communicate with axial bores or equivalent ducts provided in the roll shell. The connecting ducts 10*b*, i.e. the pipes 13, 14, comprise radial portions 13*a*, 14*a* which are connected to the inlet and outlet pipes 11, 12 of the central duct 10*a*, as well as axial portions 13*b*, 14*b* which, in a finished roll end, come perpendicularly out of the end flange and communicate with the axial ducts of the roll shell. The radial portions 13*a*, 14*a* and the axial portions 13*b*, 14*b* of the connecting ducts are connected to one another by curved portions 13*c*, 14*c*, which impart good flow properties to the medium because there are no sharp elbows and bends in the flow path but the flow path is smooth.

The pipe system 10 is assembled out of pipes, advantageously out of a seamless pipe or a hollow bar by welding, while the material is most advantageously austenitic stainless steel, for example, AISI 304L (UNS S30403, DIN 1.4306). As an advantageous alloy in the pipes of the duct system it is possible to use an alloy in which the alloy proportions are of the order (weight %): C max 0.03, Cr 18–20, Mn max 2, Ni 8–12, P max 0.045, S max 0.03, Si max 1. In the pipe system 10, a sleeve 15 advantageously made of the same material as the pipe system is disposed on the axial pipes 11, 12 of the central duct 10*a*, the sleeve 15 being closed at its ends such that a cavity defined by said sleeve 15 remains on the heat transfer medium ducts in the axle journal of the finished roll end. Said cavity can be left empty or it can be provided with a vacuum by suction. The cavity serves as a heat insulation in the axle journal reducing the heat load of a bearing to be mounted on the axle journal. When the pipe system 10 shown in FIG. 1 has been completed, it can be advantageously coated with a heat insulating layer, which will further reduce the heat load acting on the bearing. The coating is advantageously accomplished, for example, by flame spraying or by plasma spraying, and zirconium oxide ($ZrO_2$) can be used as a suitable coating material.

When the pipe system 10 forming the duct system has been completed as described above, it is placed, as shown in FIG. 2, in a mould 20, which is filled with a metal powder 1. The metal powder 1 is metal which has been made from molten metal by gas atomisation and which is in spherical powder form. The particle size of the metal powder is of the order of 0.1–0.5 mm. The metal powder can be more highly alloyed than the metal alloys manufactured by conventional methods and, for example, gas-atomised medium-carbon tempering steel powder 4140 (UNS H41400, DIN 1.7225) with an alloy (weight %): C 0.37–0.44, Cr 0.98, Fe 97, Mn 0.88, Mo 0.2, P max 0.035, S max 0.04, Si 0.23, can be advantageously used. During hot isostatic pressing (HIP) used as an advantageous process, the metal body receives its final shape and density because of a high pressure (e.g. 100–150 Mpa) and temperature (generally about 70% of the melting temperature of material). However, the metal is not in a molten state in connection with the manufacture, wherefore the properties imparted to the body which is manufactured are superior to those of bodies made by liquid methods and the material is more homogeneous than it is in bodies made by liquid methods. If it is desirable to further reduce the heat load of the bearing in a finished roll end, the material of the axle journal belonging to the roll end can be made in the manufacturing stage, to a given depth in the portion which will be immediately under the bearing, from a powder material that conducts heat more poorly than normal steel, for example, from a metal matrix composite.

Figure 2:
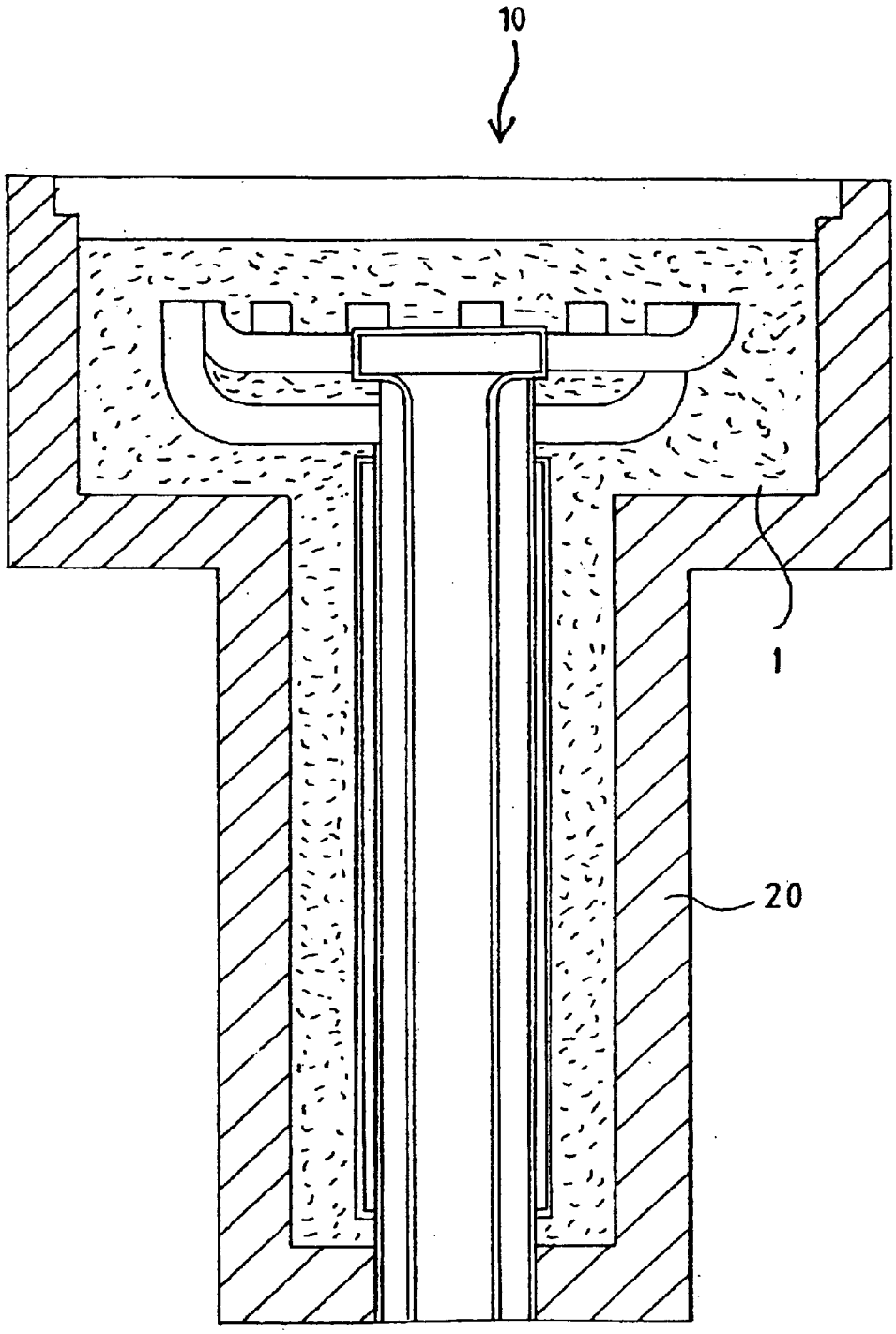
FIG. 2 is a schematic view of the stage of making the roll end in a mould when the pipe system forming the duct system has been placed inside the mould.

In FIG. 2, the mould 20 is shown to be made of a relatively thick material, but a mould made of sheet steel is usually used as a mould in the HIP process. When the body has been made ready in the mould, the mould is broken or machined off, after which the blank is machined into a desired shape and dimensions. Thus, the pipe system forming the duct system remains inside the material in the finished roll end.

Figure 3:
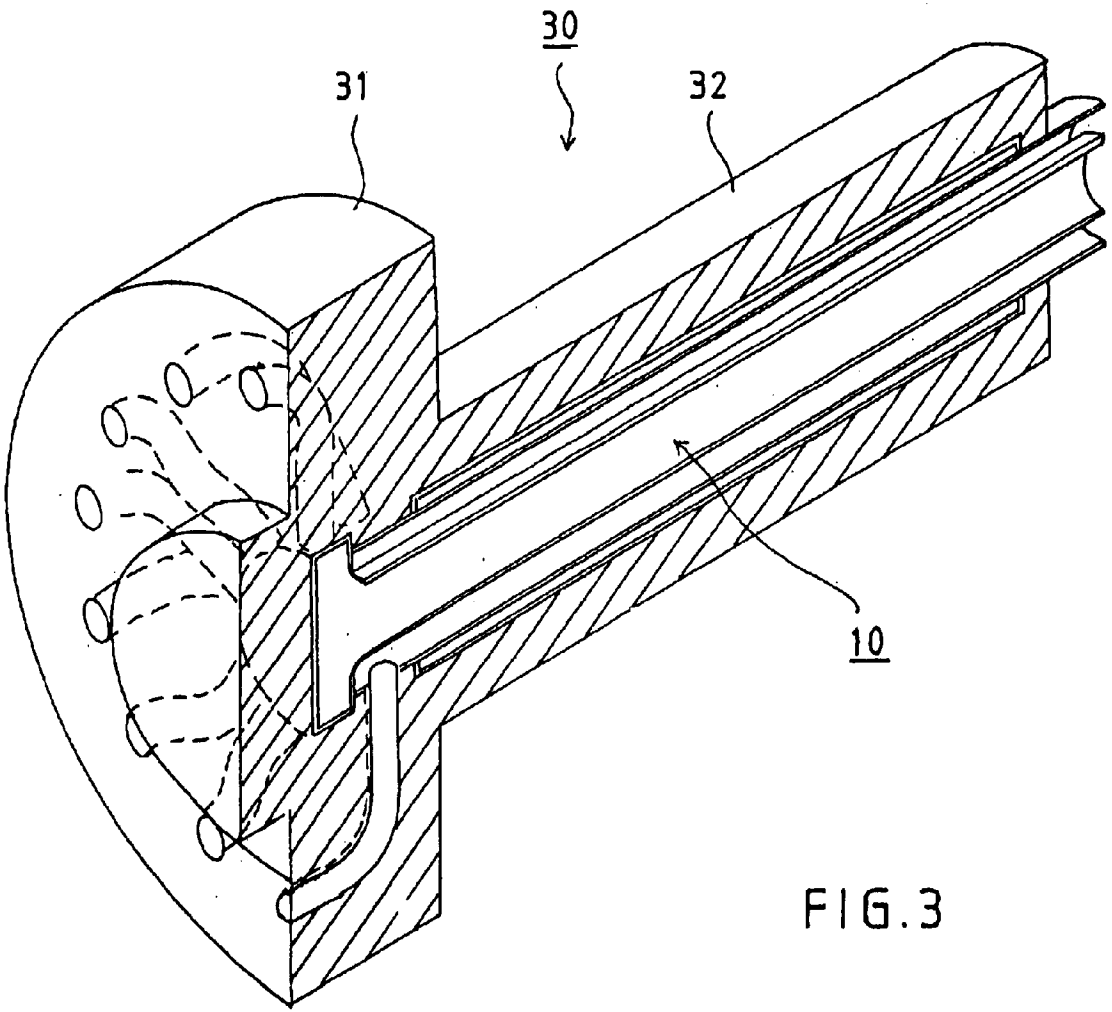
FIG. 3 is an axonometric and partial sectional view of the roll end which has been made by the method in accordance with the invention and whose outer surfaces have not yet been machined.

FIG. 3 is an axonometric and partial sectional view of a roll end 30 which has been made by the method in accordance with the invention and whose outer surfaces have not yet been machined, said roll end 30 comprising an end flange 31, an axle journal 32 and a duct system 10 for a heat transfer medium inside the roll end.

Figure 4:
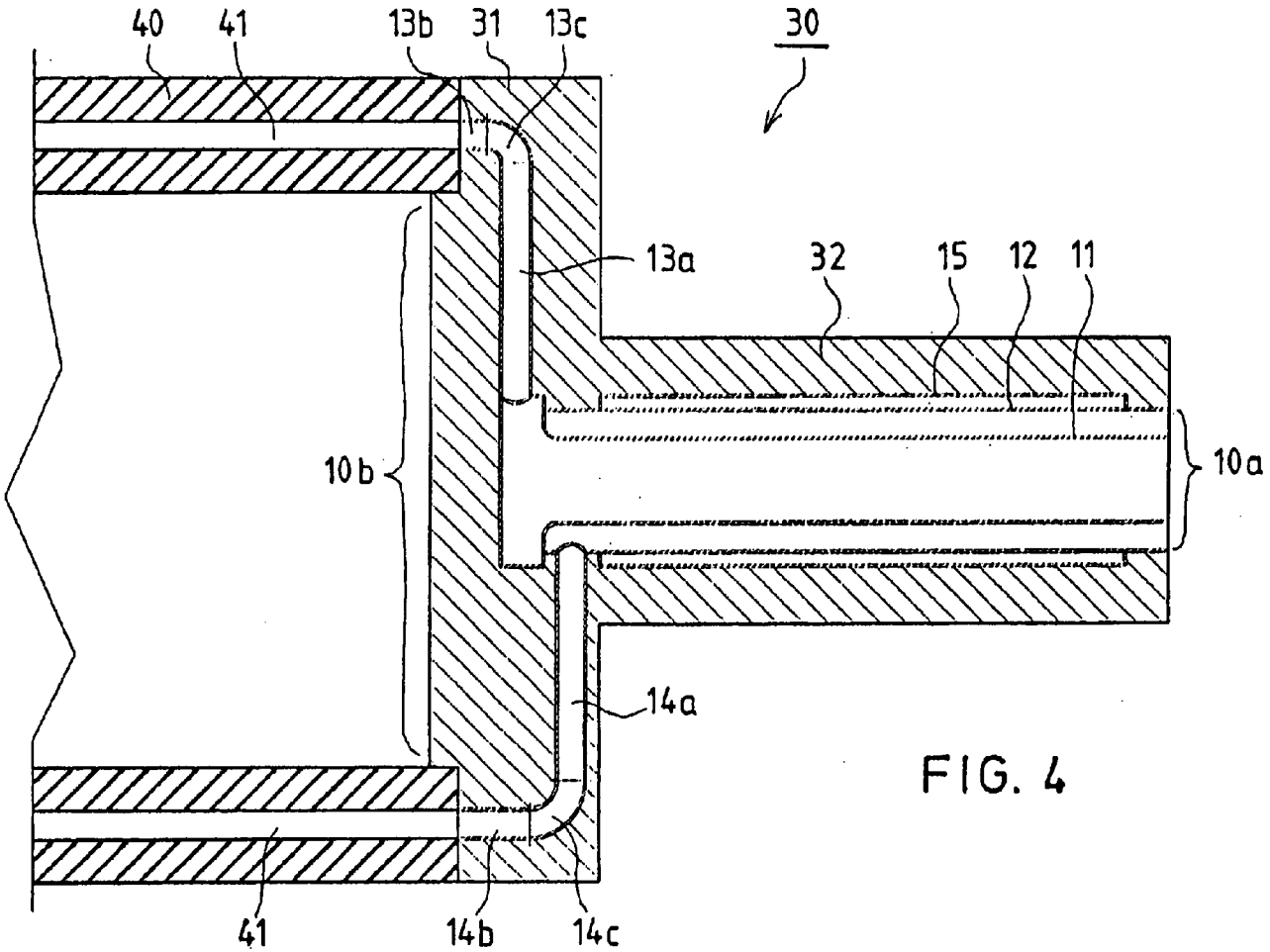
FIG. 4 is a schematic sectional view of the roll end manufactured in accordance with the invention and attached to a roll shell of a heatable roll.

Finally, FIG. 4 is a schematic sectional view of a roll end 30 manufactured in accordance with the invention and attached to a roll shell 40 of a heatable roll. This figure is intended to illustrate in particular the arrangement already described once above and, therefore, attempts have been made to present the figure as simple for the sake of clarity. For a start, FIG. 4 shows that the roll shell 40 comprises axial ducts 41 formed in it. The roll end 30 comprises an end flange 31 attached to the roll shell 40 as well as an axle journal 32 for mounting the roll by means of a bearing. The end flange 31 and the axle journal 32 are one and the same body. An axial central duct 10*a* comprising inlet and outlet pipes 11, 12 for a medium has been formed in the axle journal 32. A connecting duct system 10*b* has been formed in the end flange 31, said duct system connecting the central duct 10*a* to the axial ducts 41 of the roll shell 40. The ducts 13, 14 of the connecting duct system comprise radial portions 13*a*, 14*a* connected to the inlet and outlet pipes 11, 12 of the central duct 10*a*, axial portions 13*b*, 14*b* connected to the axial ducts 41 of the roll shell 40, and curved portions 13*c*, 14*c* connecting the radial portions 13*a*, 14*a* and the axial portions 13*b*, 14*b*. The ducts 13, 14 of the connecting duct system are not connected with one another in the end flange but have been arranged to lead as separate ducts to the axial central duct 10*a* provided in the axle journal 32. The axial portions 13*b*, 14*b* of the connecting ducts come perpendicularly out of the end flange 31, so that the flow path from the connecting ducts to the axial ducts 41 of the roll shell continues steplessly. Because of the curved portions 13*c*, 14*c* of the connecting ducts, the flow path in them is smooth.

Differing from the above description and from the illustration of the figures, the roll end 30 can also be made such that only the connecting ducts 13, 14 are formed into the roll end in connection with its manufacture, while the central duct 10*a* of the axle journal 32 can be made, for example, by boring after the manufacture of the roll end. This arrangement also provides a significant improvement over the state of the art because it is the connecting ducts 13, 14 that are difficult to make in the end flange by the known methods.

Above, the invention has been described by way of example with reference to the figures of the appended drawing. However, the invention is not exclusively confined to the example illustrated in the figures, but the different embodiments of the invention can vary within the inventive idea defined in the appended claims.

We claim:

1. A method of making a roll end for a roll in a paper or board machine or in a finishing machine, the roll end comprising an axle journal with an end flange, as well as a duct system situated inside the material of the roll end, the method comprising making the roll end by a powder metallurgy process in a mold such that the duct system has portions within the end flange of the roll end, the duct system end flange portions being formed in connection with the stage of making the roll end by the powder metallurgy process;

wherein the duct system is formed of a pipe system positioned within the mold prior to filling the mold with a metal powder and applying pressure, and wherein the pipe system is coated outside with a heat insulating coating layer before the pipe system is disposed in the mold.

2. The method of claim 1 wherein the coating is accomplished by flame spraying or by plasma spraying.

3. The method of claim 1 wherein the heat insulating coating layer is zirconium oxide.

4. The method of claim 1 wherein a high-alloy material is used as the powder metal material in the powder metallurgy process.

5. The method of claim 4 wherein the high-alloy material is a gas-atomised medium-carbon tempering steel powder.

6. A method of making a roll end for a roll in a paper or board machine or in a finishing machine, the roll end comprising an axle journal with an end flange, as well as a duct system situated inside the material of the roll end, the method comprising:

making the roll end by a powder metallurgy process by placing steel powder in a mold such that the duct system has portions within the end flange of the roll end, the duct system end flange portions being formed in connection with the stage of making the roll end by the powder metallurgy process;

wherein, in the axle journal of the roll end, a powder material that conducts heat more poorly than steel, is used at a selected depth in a region intended to be under a bearing.

7. The method of claim 6 wherein the powder material that conducts heat more poorly than steel is a metal matrix composite.

* * * * *